United States Patent [19]

Small

[11] 4,208,198

[45] Jun. 17, 1980

[54] STEPWISE TURNDOWN BY CLOSING HEAT EXCHANGER PASSAGEWAYS RESPONSIVE TO MEASURED FLOW

[75] Inventor: William M. Small, Bartlesville, Okla.

[73] Assignee: Phillips Petroleum Company, Bartlesville, Okla.

[21] Appl. No.: 804,134

[22] Filed: Jun. 6, 1977

Related U.S. Application Data

[62] Division of Ser. No. 670,214, Mar. 25, 1976, Pat. No. 4,050,506.

[51] Int. Cl.[2] ..... F25J 1/00

[52] U.S. Cl. ..... 62/21; 62/9; 62/23; 165/13

[58] Field of Search ..... 62/21, 37, 23, 9; 165/13

[56] References Cited

U.S. PATENT DOCUMENTS

| | | | |
|---|---|---|---|
| 3,158,010 | 11/1964 | Kuerston | 62/23 |
| 3,167,113 | 1/1965 | Kleiss | 62/21 |
| 3,212,277 | 10/1965 | Harper et al. | 62/23 |
| 3,212,278 | 10/1965 | Huddleston | 62/23 |
| 3,315,476 | 4/1967 | Kortlandt et al. | 62/37 |
| 3,587,731 | 6/1971 | Hays | 62/9 |
| 3,808,826 | 5/1974 | Harper et al. | 62/28 |
| 3,880,231 | 4/1975 | Gauthier | 62/11 |
| 3,895,676 | 7/1975 | Young | 62/23 |

*Primary Examiner*—Norman Yudkoff

[57] ABSTRACT

In a cryogenic plant utilizing a liquid sparged into a cold vapor in heat exchange relationship with hotter vapor, variations in the load in terms of the volume of hot vapor are compensated for by a stepwise complete closing of a uniformly-spaced-apart fraction of the cold vapor passageways.

12 Claims, 10 Drawing Figures

STEPWISE TURNDOWN BY CLOSING HEAT EXCHANGER PASSAGEWAYS RESPONSIVE TO MEASURED FLOW

CROSS REFERENCE TO RELATED APPLICATION

This is a divisional of copending application, Ser. No. 670,214, filed Mar. 25, 1976, now U.S. Pat. No. 4,050,506.

BACKGROUND OF THE INVENTION

This invention relates to heat exchangers using sparged liquid refrigerant in cryogenic plants.

It is known to utilize a heat exchanger employing a sparged liquid into a cold vapor, the resulting mixture being passed in heat exchange relationship with a hotter vapor as shown by Young, U.S. Pat. No. 3,895,676 issued July 22, 1975, the disclosure of which is hereby incorporated by reference. Such heat exchangers are particularly useful in liquefying gases as, for instance, in the production of liquefied natural gas. In such operations there is a problem of maintaining good heat transfer during variations in the loading (throughput). As a result of various factors such as partial shutdown for repairs and maintenance, changes in the production rate of the natural gas, and the like, the heat load on the heat exchangers in terms of the volume of hot vapor may vary by as much as a factor of 10. In an ordinary heat exchanger, such variation may be tolerated. However, in heat exchangers employing as a refrigerant a cold liquid sparged into a cold vapor, a decreased heat load reduces the volume of refrigerant which causes a maldistribution of the liquid phase into the parallel heat exchange passageways and ultimately insufficient vaporization of the cold liquid and flooding and blockage of some of the refrigerant passageways and no liquid in others. This causes a severe loss of efficiency in the heat exchange operation with recognition and positive action being required to correct such a condition.

SUMMARY OF THE INVENTION

It is an object of this invention to provide for stepwise turndown of a cryogenic plant;

It is a further object of this invention to avoid liquid accumulation in passageways of a heat exchanger utilizing a liquid sparged into a vapor;

It is yet a further object of this invention to maintain maximum efficiency of heat transfer in a cryogenic plant during variations in the load.

In accordance with this invention, uniformly spaced apart fractions of passageways carrying liquid sparged into cold vapor are completely closed off in response to a significant decrease in the load.

BRIEF DESCRIPTION OF THE DRAWINGS

In the drawings, forming a part hereof, wherein like reference characters denote like parts in the various views.

DESCRIPTION OF THE PREFERRED EMBODIMENTS

The apparatus of this invention is applicable in any cryogenic heat exchange operation and is of particular utility in connection with a liquefied natural gas plant.

Figure 1:
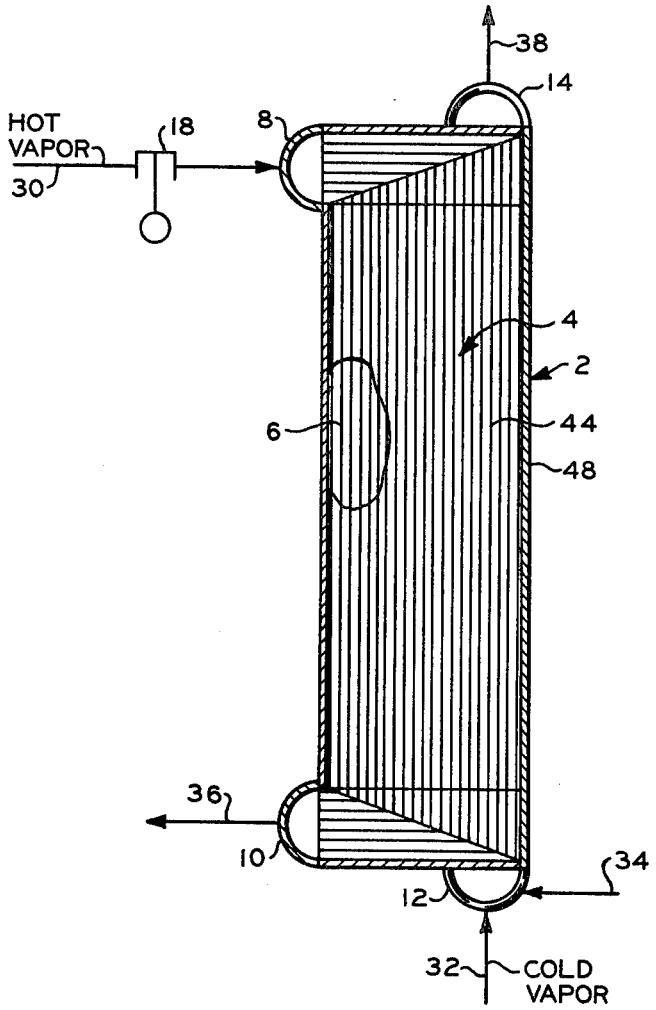
FIG. 1 is a side elevation with the side plate removed showing one vertical passageway and header system in diagrammatic form.
Figure 2:
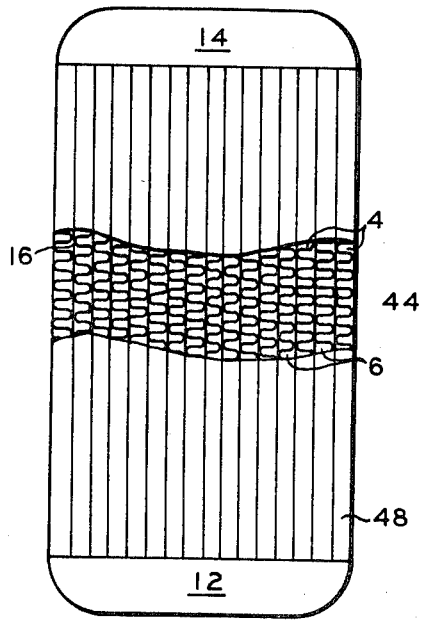
FIG. 2 is a view taken at right angles to that of FIG. 1 with a portion of the end bars cut away so as to show alternate passageways 4 and 6.

Referring now to the drawings, particularly FIG. 1, there is shown an elongated heat exchanger 2 having a core comprised of a stack of elongated longitudinally extending platelike passages. As can be seen from FIG. 2, there are alternately spaced first and second fluid passages 4 and 6, respectively, only a single passage 4 being directly visible in FIG. 1, passage 6 being shown by cutout. Each passage is formed by interposing fin material 44 (see FIG. 4) between two spaced metallic plates 16 (see FIG. 2 or 3). The formation of such passages is well known to those skilled in the art. The composite of these platelike passages may then be brazed together as an integral unit.

Communicating with first fluid passages 4 are first inlet and outlet headers 8 and 10, respectively. Communicating with second fluid passages 6 are second inlet and outlet headers 12 and 14, respectively. Hot vapor carried by a line 30 is conveyed by means of gas compressor 18 to first inlet header 8 and thence through first fluid passageways 4, collected by first outlet header 10 and removed by hot vapor outlet line 36 (i.e., means to removed the thus cooled fluid). Cold vapor is conveyed by line 32 to second inlet header 12 and thence through second fluid passages 6, collected by second outlet header 14, and removed via refrigerant outlet line 38. Liquid from liquid refrigerant inlet line 34 is sparged into the vapor at the entrance to the second fluid passages by means such as that shown in detail in FIG. 3. Other conventional sparging means can also be used. Once distributed within a passage, the heat exchange fluid moves longitudinally through and around longitudinally extending perforated fin material 44 (see FIG. 4) to the opposite end of the passage. The fin material can be formed from corrugated sheet or otherwise fabricated metal such as solid or perforated aluminum as with apertures 46 which are shown in detail in FIG. 4. These apertures may comprise from about 10 to 20 percent of the total sheet metal surface. The fluid material is confined within the heat passageway by end bars 48.

Figure 3:
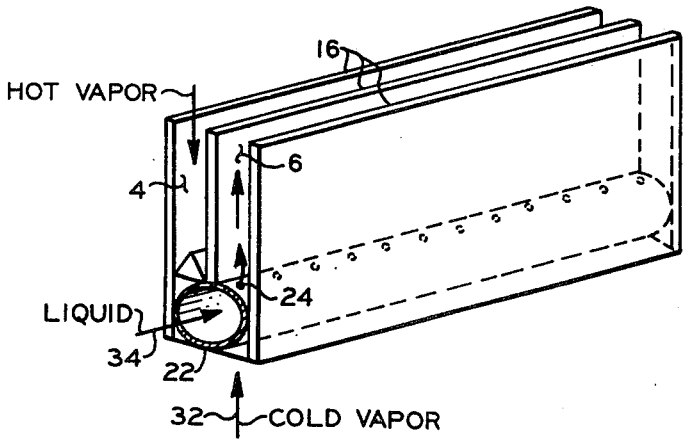
FIG. 3 is a detailed perspective view of one sparger means suitable for introducing liquid into the vapor.
Figure 4:
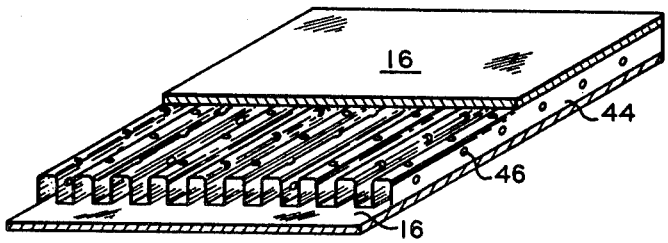
FIG. 4 is a perspective view of a portion of perforated fin material used in the heat exchanger platelike passages.

Referring now specifically to FIG. 3, there is shown a preferred means for sparging the liquid into the cold vapor comprising conduit 22 positioned in each of the second fluid passages 6 communicating with second inlet header 12 and lines 32 and 34 as shown in FIG. 1. Each of the conduits 22 has a plurality of fluid exit openings 24 formed along its length and opening into the respective fluid passageways 6 for passing and distributing a liquid from the conduit into the second fluid passages 6.

Figure 5:
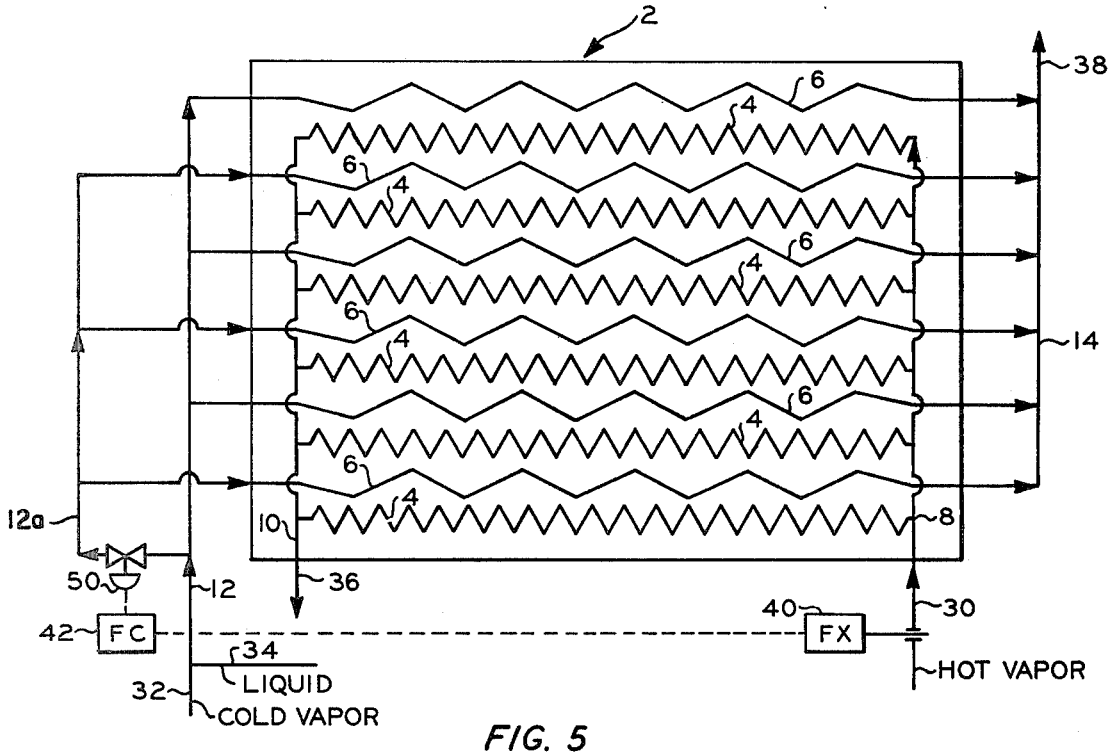
FIG. 5 is a schematic representation of a heat exchanger having a turndown ratio of ½.

Referring now to FIG. 5, there is shown a heat exchanger 2 in more diagrammatic form employing the turndown control of this invention. As can be seen, hot vapor enters via line 30 and is distributed by means of header 8 to alternate passageways 4. Header 10 collects the resultant fluid and passes same from the heat exchanger via line 36. Cold vapor enters via line 32 and liquid via line 34 and the two phase stream is distributed by header 12 to the other alternate passageways 6, the warmed refrigerant exiting by header 14 and line 38. Flow controller 42 operates valve 50 one half of header 12 in response to a measured rate of flow of the hot vapor. This operation is carried out by linear flow transmitter 40 which transmits a signal representative of the flow rate in conduit 30. When the rate of flow is reduced to a preset level or lower, flow controller 42 closes valve 50. This shuts off line **12*a* to one-half of the second inlet header system 12, thus shutting off the cold vapor and liquid being sparged into alternate second passageways 6. As can be seen, every other passageway 6 is shut off, this being every fourth passageway since half of the passageways are hot vapor passageways. It is essential that the fraction of the refrigerant passageways shut off be substantially uniformly spaced apart. In this way the entire heat exchanger core is always used to its maximum efficiency. This avoids an entire section being unused since even the passageways shut off still conduct heat as a result of their proximity to the active passageways. Thus, the sequence is a hot vapor passageway 4, a closed off cold vapor passageway 6, a hot vapor passageway 4, and an open cold vapor passageway 6**, etc. Similarly, a turndown ratio in increments of successive one-thirds can be effected by shutting off every third refrigerant passageway and a turndown ratio in increments of successive one-fourths can be achieved by completely shutting off every fourth refrigerant passageway.

Figure 6:
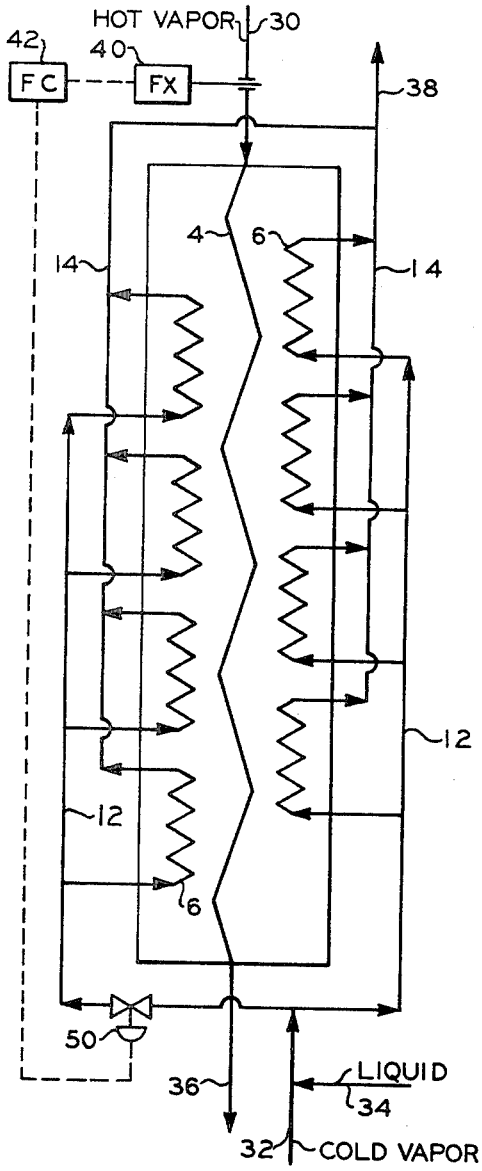
FIG. 6 is a schematic representation similar to FIG. 5 utilizing another conventional shorthand (schematic) method of depicting the passageways.

Referring now to FIG. 6, there is shown a schematic representation of a heat exchanger identical to that of FIG. 5. FIG. 5 is duplicated in order to introduce another shorthand form for depicting the hot vapor passageways 4 and the alternating, parallel, countercurrent cold vapor passageways 6. As is apparent, this does not represent the actual spaced relationship of the passageways but is a conventional shorthand form depicting passageways in a complex multipass heat exchanger. For instance, passageway 4 depicted in FIG. 6 is actually a plurality of passageways having passageways 6 sandwiched therebetween.

Figure 7:
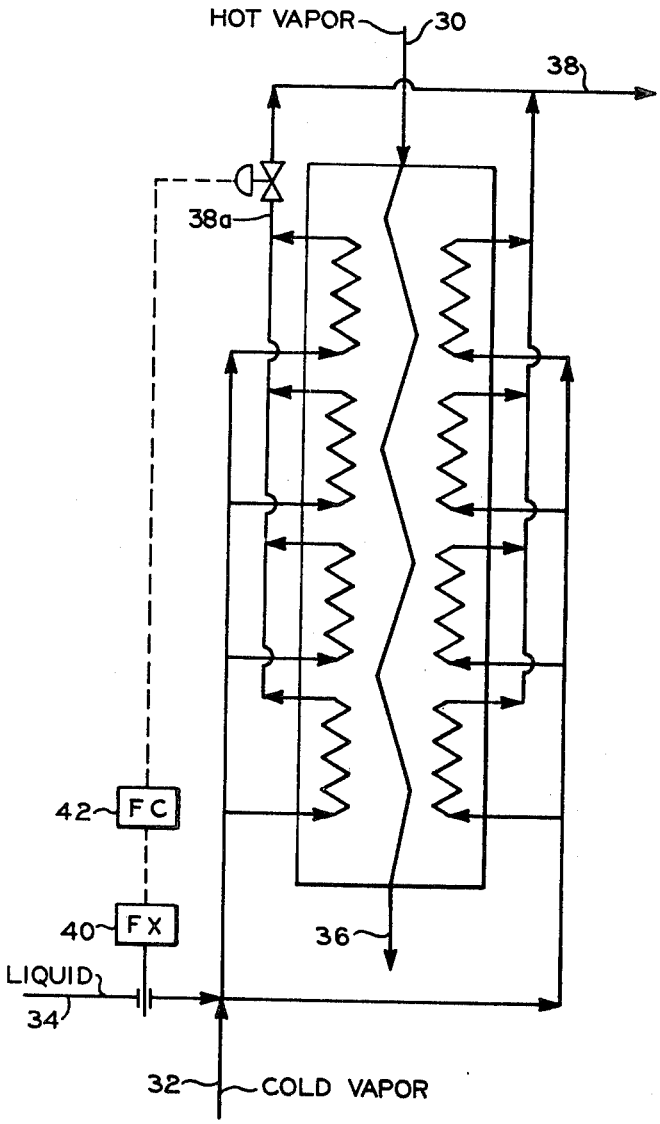
FIG. 7 is a view similar to FIG. 6 showing the flow control valve placed downstream of the heat exchanger.

FIG. 7 is a schematic representation of a heat exchanger similar to FIG. 6 except that the flow transmitter measures the flow rate of cold liquid and in response to a decreased flow, the controller shuts off a refrigerant exit line **38*a* rather than an inlet line, thereby both the measurement and control loci are different from FIGS. 5 and 6. In order to have a more accurate measurement, it is essential to measure a reliably single phase flow rate. Accordingly, the preferred measured stream is that as shown in FIGS. 5 and 6**, where the flow rate of hot vapor is measured. However, in certain plants such as liquefied natural gas plants where the liquid is produced by compressing and cooling hot vapor, the flow rate of liquid is proportional to or at least correlatable with the incoming flow rate of hot vapor.

Figure 8:
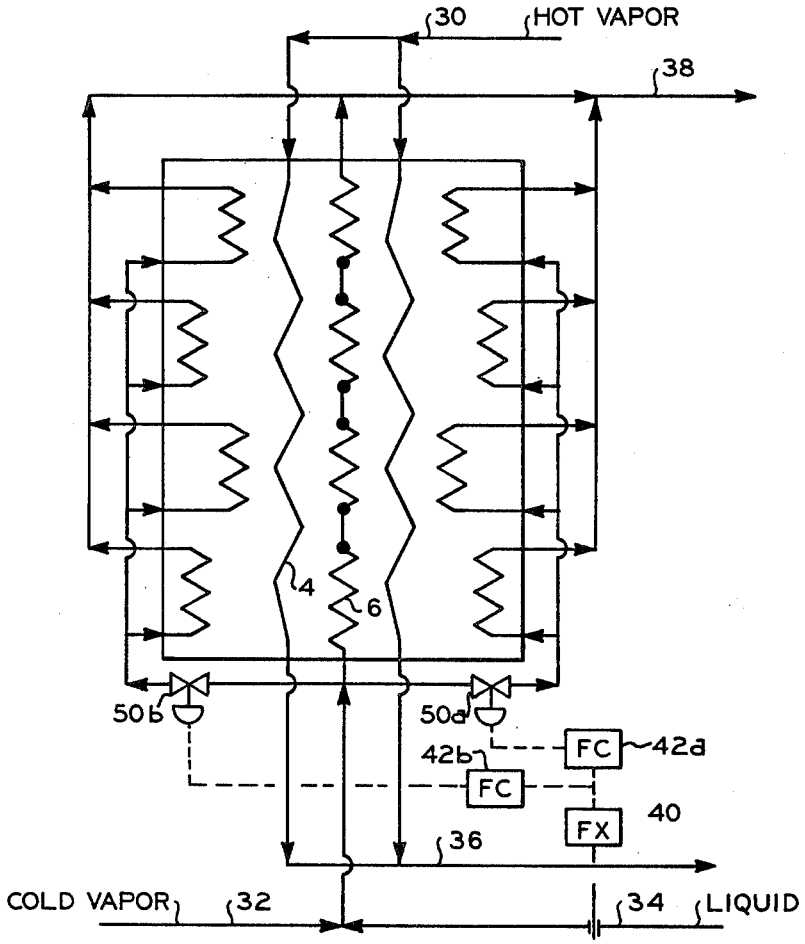
FIG. 8 is a view similar to FIGS. 6 and 7 showing a system capable of a turndown ratio in increments of ⅓.

FIG. 8 is similar to FIG. 7 except that there are provided two flow controllers **42*a* and 42*b* operating valves 50*a* and 50*b*, respectively, so as to shut off completely uniformly-spaced-apart refrigerant feed lines in increments of $\frac{1}{3}$ of the total number in the heat exchanger. Also, in this embodiment, the refrigerant liquid flow rate coming into the heat exchanger is utilized to regulate when the stepdown is to occur. Thus, when the flow rate of liquid is reduced to a preset level of less than $\frac{2}{3}$ but more than 166 of the normally expected flow rate, flow controller 42*a*, in response to the comparison of its signal from linear flow transmitter 40 with the $\frac{2}{3}$ flow rate set point thereto, shuts off valve 50*a*, thus completely shutting off the uniformly-spaced-apart $\frac{1}{3}$ fraction of the refrigerant lines. When the liquid flow rate is further reduced to a second preset level (less than $\frac{1}{3}$ normal flow), flow controller 42*b* shuts off valve 50*b*, thus shutting off a second bank of refrigerant lines leaving only a single uniformly-spaced-apart 166** fraction of the refrigerant lines in operation.

Figure 9:
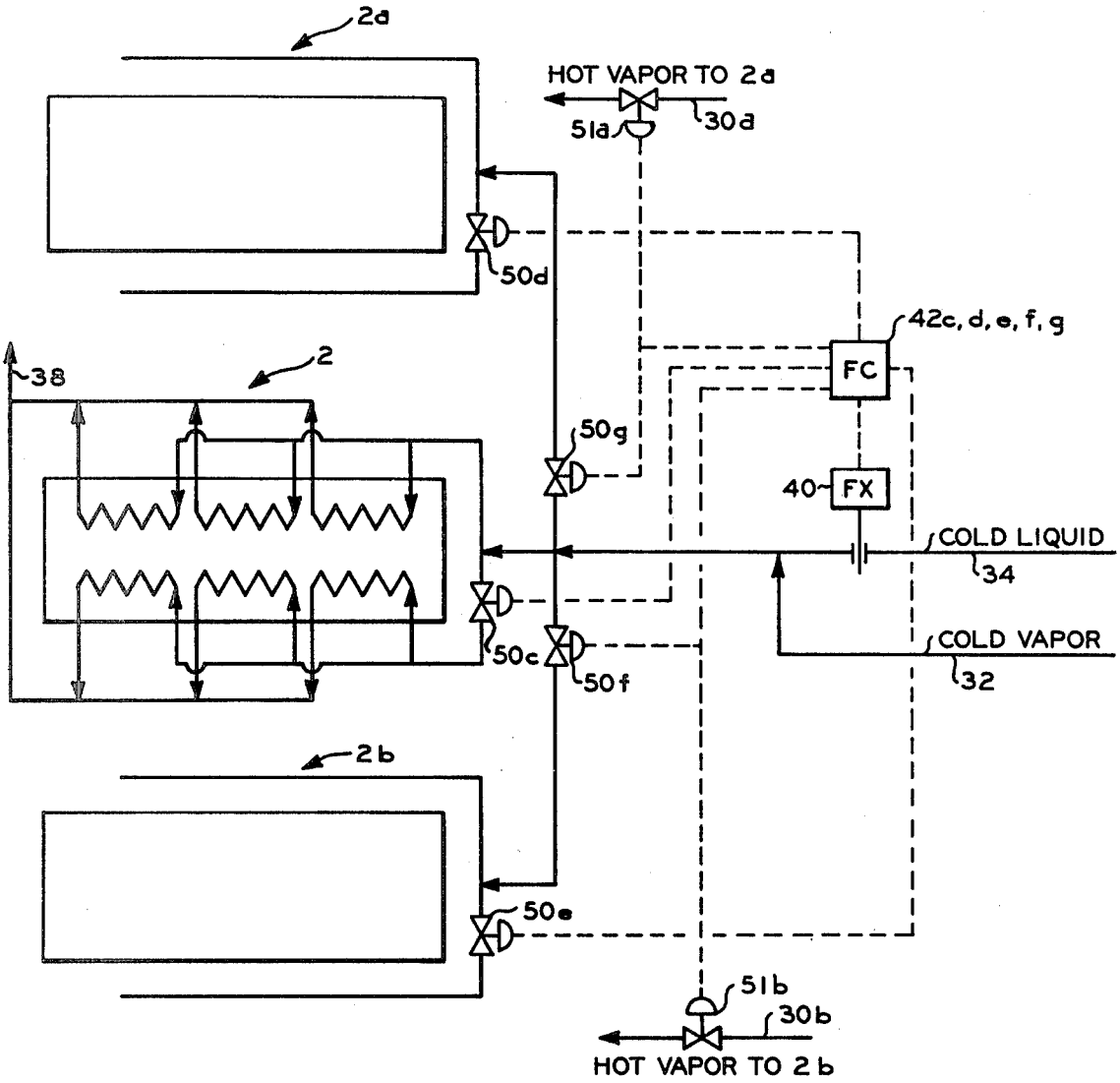
FIG. 9 is a schematic representation of the inventive control system applied to three parallel trains of heat exchangers.

FIG. 9 is a schematic representation of three parallel trains of heat exchangers as would be employed in a cryogenic plant. In this embodiment, the liquid flow into the system is measured for control purposes, however, hot vapor flow rate measurement could be employed by utilizing only $\frac{1}{2}$ turndown ratio in each of the three parallel trains and by shutting down one train completely after first having shutdown one uniformly-spaced-apart $\frac{1}{2}$ of the refrigerant lines therein, it is possible to achieve a turndown ratio of 1/6, $\frac{1}{3}$, $\frac{1}{2}$, $\frac{2}{3}$, or 5/6. By utilizing the $\frac{1}{3}$ increment turndown system of FIG. 8 in each of the parallel trains of FIG. 9, it would be possible to operate in increments ranging from 1/9 to 100 percent of the total capacity. Minor variations in the load on the heat exchange plant can be tolerated and thus with turndown ratios such as those depicted herein, two-phase-refrigerant heat exchangers can be operated at high efficiency as the actual material being processed varies from 100 percent to as little as about 10 percent of the designed capacity of the plant, a particularly useful feature when starting up and when plant throughput is being changed. Specifically, again referring to FIG. 9, there is shown three parallel trains of physically-separated heat exchangers 2, **2*a* and 2*b*. Linear flow transmitter 40, in response to the volume of total refrigerant liquid flow through line 34, operates flow controller 42*c*** through *g*. Controller 42 can be five separate controllers with the five setpoints representing successively 5/6, 4/6, 3/6, 2/6 and 1/6 of scale or in a preferred direct digital control system, the controller can be represented by one equation in a computer with five different setpoint values, one being applied to each control loop with the controller being switched periodically as desired, outputting control signals to all values in sequence. As the liquid flow rate drops to the first preset level, valve **50*c* is actuated, thus giving a turndown ratio of $\frac{1}{2}$ in exchanger 2 or a turndown ratio of 1/6 for the entire plant. When the measured liquid flow rate reaches a second preset level, valve 50*d* is actuated to shut down one-half of the uniformly-spaced-apart refrigerant lines in exchanger 2*a*. When the liquid flow rate is reduced to the third preset value, the valve 50*e* is actuated to shut off the uniformly-spaced-apart half of the refrigerant lines in exchanger 2*b* to give a total plant turndown ratio of $\frac{1}{2}$. On reaching the fourth preset value of liquid flow rate, valve 50*f* is closed, thus completely shutting off exchanger 2b to give a total turndown ratio of ⅔. At this point of successive turndown, with all refrigerant shut off to exchanger 2b, valve 51b on the hot vapor stream to 2b is also shut off to prevent by-passing of hot vapor around coolers 2 and 2a (still being refrigerated at half-capacity each). On reaching the final setpoint, valve 50g is actuated shutting off completely exchanger 2a to give the total turndown ratio of 5/6. Valve 51a is also actuated to shut off hot vapor to 2a for the aforementioned reason. Alternatively as desired, both halves of a single exchanger could be turndown prior to shutting down ½ of the second parallel exchanger with appropriate shut off of hot vapor flow. Since hot vapor distribution among the parallel exchangers would become disproportionate with the refrigerant supply, for example at the turndown ratio of 1/6, valve 50c being closed, only 1/6 of the previous total refrigerant supply (1/5 of the present supply) would be allotted to exchanger 2** while ⅓ of the hot vapor would pass therethrough. In the event of partial condensation rather than mere coolings of the hot vapor, it might become desirable to additionally manipulate the distribution of the hot vapor supply for the purpose of obtaining approximately the same degree of cooling and possible partial condensation of the hot vapor whereby mixing steps (to achieve uniform temperatures) applied to the cooled hot vapor stream and the vaporized-heated refrigerant stream may be avoided. Thus, potential uniformity problems which might plague further processing steps (phase separations, further heat exchange, etc.) may be avoided. Instrumentation of the character previously described may thereby be applied to the hot vapor stream, as well upon recognition of a problem.

Figure 10:
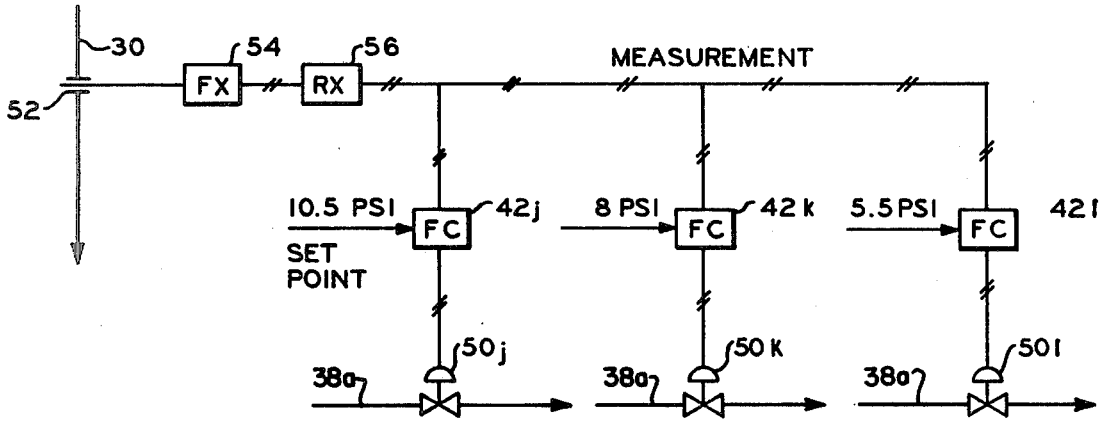
FIG. 10 is a schematic representation of another suitable control means for use in the invention.

Referring now to FIG. 10, there is shown a schematic representation of one form of control apparatus. Herein orifice or similar head metering device 52 in hot vapor line 30 allows communication between the line carrying vapor, the flow of which is to be measured, and differential pressure transmitter 54. This transducer transmits a signal representative of the square of the flow rate which is fed to square root computing-scaling relay 56. Differential transmitter 54 and square root computing relay 56 together make up a linear flow transmitter. Other conventional automatic control devices, preferably combining these functions in one unit, may be employed. This signal is then fed to a series of flow controllers 42j, *k* and *l* to close off the refrigerant exit lines 38a. Controller 42 is set to close valve 50j when the measurement signal (its pneumatic analog) falls below ¾ of normal flow rate, which is represented by the setpoints given below. Similarly, flow controllers 42k and 42l receive setpoints representing, respectively, one-half and one-fourth of normal flow rate. This then depicts the usual method of flow metering by orifice where the differential pressure is representative of the flow rate squared. The standarized pneumatic instrumentation scale range is 3 to 15 psi (20.7 to 30.4 kilopascals) air pressure full scale. In this example, the orifice and transmitter are sized and scaled whereby a 13 psi (89.6 kPa) signal indicates expected maximum throughput. Thus, a 10.5 psi (72.4 kPa) measurement signal indicates a ¾ rate of operation, necessitating a ¼ turndown, an 8 psi (55.2 kPa) signal similarly necessitates a ½ turndown and a 5.5 psi (37.9 kPa) signal necessitates a ¾ turndown so that when the flow rate drops slightly below the 10.5 psi (72.4 kPa) signal, controller 42j (adjusted to a high gain setting) closes valve 50j on one of four parallel passes of the two-phase-refrigerant heat exchanger. Valve closure can be delayed or lagged as desired by conventional means to avoid pressure shock. Either electrical or pneumatic signals can be utilized between flow transducers, square root computing relay and flow controllers and the control configuration may be totally analog or partially digital in character as known to those skilled in this art.

Turbine flow meters or other types of measuring devices could be used which give a signal directly related to the refrigerant flow rate and thus do not require a square root calculation. While electrical differential pressure transmitter relay and controllers could be used, pneumatic equipment is preferred so as to avoid any explosion hazard such as may be present in liquefied natural gas processing.

Typical inlet temperature ranges for liquefied natural gas plant using three stages, each utilizing the turndown arrangement of this invention are as follows:

| | 1st | 2nd | 3rd |
|---|---|---|---|
| Hot vapor inlet | 50° to 80° F. | −25° to −40° F. | −65° to −80° F. |
| Cold vapor inlet | −35° to −50° F. | −75° to −90° F. | −180° to 190° F. |
| Liquid inlet | −35° to −50° F. | −75° to −90° F. | −180° to −190° F. |

Calculated Illustrative Embodiment

A liquefied natural gas separations plant is operated utilizing an exchanger as shown in FIG. 8, which has a pneumatic system so as to allow shutting down uniformly spaced ⅓ or ⅔ fractions of the total number of cold vapor passageways.

The heat exchanger dimensions and stream flow conditions for the exchanger are as follows:

| | |
|---|---|
| Hot Vapor Passageway | 17 passages having a thickness of 0.20" (5.1 mm) and having 0.20" (5.1 mm) high perforated fins therein, 14 fins/inch .012" (0.3 liquefied fin thickness, each passage 32" (0.813 m) wide and 5 ft. (1.52 m) long, total free cross section 0.58 ft.$^2$ (0.054 m$^2$) |
| Cold Vapor Passageway | 18 passages having a thickness of 0.25" (6.4 mm) and having 0.25" (6.4 mm) high ⅛-inch (3.2 mm) lanced fins therein, 15 fins/inch .012" (0.3 mm) fin thickness, each passage 32" wide (0.813 m) and 3 ft. (1.52 m) long, total free cross section 0.78 ft.$^2$ (0.0725 m$^2$) |
| Stream Properties | flow rate 30,000 lb/hr (13608 Kg/hr) |
| Hot Vapor Stream | composition 89.5% $CH_4$ 10.5% $H_2$ Inlet temperature = 0° F. (−18° C.), Inlet pressure = |

-continued

| | |
|---|---|
| | 505 psia (3481.9 k Pa)<br>Outlet temperature = −133° F. (−91.7° C.), ($CH_4$ totally condensed)<br>Outlet pressure - 500 psia (3447.4 k Pa) |
| Cold Vapor Stream | flow rate 26850 lb/hr (12179 Kg/hr)<br>composition 100% $CH_4$<br>Inlet temperature = −205° F. (−131.7° C.), inlet pressure = 96 psia (661.9 k Pa) |
| Liquid Stream | flow rate 21,500 lb/hr (9752 Kg/hr) liquefied methane<br>Inlet temperature = −205° F. (−131.7° C.), inlet pressure = 100 psia (609.48 k Pa)<br>liquid injected into cold vapor stream through two (one from each side) 7/16" (11.1 mm) OD .020 (5.1 mm) wall 16" (0.406 m) long tubes/passage. Total of 36 tubes per heat exchanger flow rate/tube = 596 lb/hr (270 Kg/hr). Tube having 0.035" (0.9 mm) diameter orifices on ¼inch (6.4 mm) centers through which liquid passes at a velocity of 15 ft/sec. |

While this invention has been described in detail for the purpose of illustration, it is not to be construed as limited thereby but is intended to cover all changes and modifications within the spirit and scope thereof.

I claim:

1. A method of controlling a heat exchanger comprising:

introducing hot gas into a first group of passageways;

introducing cold vapor into a second group of passageways spaced alternately with said first group, sparging a liquid into said second group of passageways along with said cold vapor and passing said thus sparged liquid and cold vapor in countercurrent heat exchange relationship with said hot gas;

measuring the flow of said hot gas into said first group of passageways; and completely shutting off passageways that are selected from every second, every third and every fourth passageway of said second group of passageways responsive to a reduction in flow to said first group of passageways.

2. A method of controlling a heat exchanger comprising:

introducing hot gas into a first group of passageways;

introducing cold vapor into a second group of passageways spaced alternately with said first group, sparging a liquid into said second group of passageways along with said cold vapor and passing said thus sparged liquid and cold vapor in countercurrent heat exchanger relationship with said hot gas;

measuring flow of said liquid to said second group of passageways; and completely shutting off passageways that are selected from every second, every third, and every fourth passageway of said second group of passageways responsive to a reduction in flow of said liquid to said second group of passageways.

3. A method of controlling a heat exchanger comprising:

introducing hot gas to a first group of passageways;

introducing cold vapor to a second group of passageways spaced alternately with the first group, sparging a liquid into the second group of passageways along with the cold vapor, and passing the thus sparged liquid and cold vapor into countercurrent heat exchange relationship with the hot gas; and shutting off flow through passageways that are selected from every second, every third, and every fourth passageway of said second group of passageways responsive to a reduction in the load on the heat exchanger.

4. A method according to claim 3 in which the reduction in the load on the heat exchanger is detected by measuring the flow of the hot gas to a first group of passageways.

5. A method according to claim 4 wherein said hot vapor comprises methane and hydrogen at a temperature of about 0° F., said cold vapor stream is essentially methane at a temperature of about 205° F.; and said liquid stream is essentially liquefied methane at a temperature of about −205° F.

6. A method according to claim 4 wherein flow of said cold vapor and sparged liquid through said selected passageways of said second group of passageways is shut off by closing an inlet thereto.

7. A method according to claim 6 wherein said hot vapor comprises methane and hydrogen, said cold vapor stream is essentially methane, and said liquid stream is essentially liquefied methane.

8. The method according to claim 7 wherein said hot vapor comprising said methane and hydrogen is at a temperature of about 0° F., said cold vapor stream is essentially methane and is at a temperature of about −205° F. and said liquid stream of essentially liquefied methane is at a temperature of about −205° F.

9. A method according to claim 3 in which the reduction in the load on the heat exchanger is detected by measuring the flow of the liquid to the second group of passageways.

10. A method according to claim 9 wherein said hot vapor comprises methane and hydrogen at a temperature of about 0° F., said cold vapor stream is essentially methane at a temperature of about −205° F.; and said liquid stream is essentially liquefied methane at a temperature of about −205° F.

11. A method according to claim 9 wherein flow of said cold vapor and sparged liquid through said selected passageways of said second group of passageways is shut off by closing an inlet to said second group of passageways.

12. A method according to claim 9 wherein flow of said cold vapor and sparged liquid through said selected passageways of said second group of passageways is shut off by closing an outlet to said second group of passageways.

* * * * *